US006125663A

United States Patent [19]

Weber

[11] Patent Number: 6,125,663

[45] Date of Patent: Oct. 3, 2000

[54] METHOD AND APPARATUS FOR MONITORING SCANNING CONDITIONS DURING CONTROL OF A YARN FEEDING DEVICE

[75] Inventor: Friedrich Weber, Herzogsweiler, Germany

[73] Assignee: Memminger-Iro GmbH, Dornstetten, Germany

[21] Appl. No.: 09/077,645

[22] PCT Filed: Dec. 3, 1996

[86] PCT No.: PCT/EP96/05383

§ 371 Date: Mar. 8, 1999

§ 102(e) Date: Mar. 8, 1999

[87] PCT Pub. No.: WO97/21620

PCT Pub. Date: Jun. 19, 1997

[30] Foreign Application Priority Data

Dec. 8, 1995 [DE] Germany ..... 195 45 891

[51] Int. Cl.[7] ..... B65H 51/22

[52] U.S. Cl. ..... 66/132 R; 139/452; 250/205; 242/364.8

[58] Field of Search ..... 139/452; 66/132 R, 66/132 T; 356/431; 250/208.2, 205; 242/364.8

[56] References Cited

U.S. PATENT DOCUMENTS

| | | | |
|---|---|---|---|
| 3,907,440 | 9/1975 | Eichenberger et al. . | |
| 4,769,532 | 9/1988 | Kawakami | 250/205 |
| 4,865,085 | 9/1989 | Ghiardo . | |
| 4,963,757 | 10/1990 | Liefde et al. . | |
| 5,377,922 | 1/1995 | Fredriksson et al. | 242/47.01 |
| 5,613,528 | 3/1997 | Zenoni et al. | 139/452 |
| 5,694,979 | 12/1997 | Toda | 26/70 |
| 5,765,399 | 6/1998 | Huss et al. | 66/132 R |

FOREIGN PATENT DOCUMENTS

| | | |
|---|---|---|
| 2 227 092 | 7/1990 | United Kingdom . |
| WO 95/16628 | 6/1995 | WIPO . |

*Primary Examiner*—Andy Falik

*Attorney, Agent, or Firm*—Flynn, Thiel, Boutell & Tanis, P.C.

[57] ABSTRACT

A method and apparatus for monitoring the scanning conditions when controlling a yarn feeding device including a storing surface for the yarn, a drive motor, a sensor device having at least one sensor oriented towards a scanning zone defined in the yarn feeding device, and a control circuit connected to the sensor device. The sensor generates an object-output signal for control purposes in response to the movement, absence or presence of an object in the scanning zone. A test signal is formed from and substantially synchronously with the object-output signal, and the signal level of the test signal is compared with an alarm threshold value representing a just barely acceptable deterioration level of the scanning conditions. An alarm signal is generated when the signal level of the test signal falls below a predetermined threshold value.

16 Claims, 3 Drawing Sheets

L
M
E
D
G
C
V
+12 V
+12 V
D1
D2
D3
D4
D5
D6
D7
D8
D9
T1
T2
T3
S
S
S

METHOD AND APPARATUS FOR MONITORING SCANNING CONDITIONS DURING CONTROL OF A YARN FEEDING DEVICE

FIELD OF THE INVENTION

The present invention relates to a method and apparatus for monitoring scanning conditions during the control of a yarn feeding device including a sensor device oriented towards a scanning zone defined on a yarn storing surface. The sensor device senses motion or the presence or absence of an object in the scanning zone, and a control circuit processes an output signal of the sensor device to control a drive motor for replenishing the yarn storing surface with yarn.

BACKGROUND OF THE INVENTION

Such a method is disclosed in U.S. Pat. No. 4,865,085 (corresponding to EP-0 199 059 BI). In this method, the sensor device operates with a receiver which monitors the axial movement of yarn windings on a stationary storing drum, and a second receiver monitors the quality of the light transmission. An output signal of the second receiver is compared with a threshold value in order to provide an additional useful signal which serves to increase the light intensity for both receivers when the light transmission has deteriorated. Also, an alarm signal for an operator can be generated indicating the necessity for cleaning of the light transmission path by removing contaminants which disturb or block the light transmission.

In a method disclosed in U.S. Pat. No. 4,963,757, a light source feeds two receivers, one of which scans a yarn and the other scans only the light transmission quality in order to maintain the relation between the output signals of both receivers substantially constant, and to compensate for a deterioration of the light transmission quality.

According to a method disclosed in U.S. Pat. No. 3,907,440, phase-offset light pulses for one receiver are generated by means of two pulsed light sources, and a yarn is scanned only with the light pulses of one of the light sources. The output signals originating from the light pulses not used for yarn scanning are compared with a nominal signal value in order to maintain a predetermined relation between both signals and to compensate for disturbing influences.

GB-A-22 27 092 discloses an optoelectronic sensor which consists of a light source and a receiver. The sensor is checked in a bank-note receiving and discharging device as to the instantaneous scanning characteristics before the sensor takes part in the checking of a bank note. In a test routine, a state, as may later be found in testing a bank note, is simulated by darkening the light source at the control side, as compared with the normal light intensity of the light source. The level of resulting output signals of the receiver is compared with a threshold value level calculated by the control device from those output signals of the receiver that are obtained without and with the darkening action. If the level of the darkened output signal is below the threshold value level, an alarm will be initiated.

According to another method known from WO95/16628 and used for controlling the drive motor of a yarn feeding device for a knitting machine, the yarn feeding device includes a rotatably driveable storing drum defining a storing surface and a stationary sensor device. Circumferentially offset surface areas of the storing surface are simultaneously optoelectronically scanned in the scanning zone by means of a plurality of sensors. In case where yarn is present in the scanning zone, the sensors simultaneously output identical output signals. In contrast, when yarn is absent from the scanning zone, the sensors simultaneously generate different output signals. By discrimination between the output signals, control signals are derived, and the drive motor is driven as long as the scanning zone is free from yarn, until yarn reaches the scanning zone again. When replenishing the yarn store, i.e., in the driven state of the drive motor, a speed signal for the control circuit is derived from the output signal of a sensor. A predetermined quality of the light transmission is required for the operation of the sensor device. Contaminants and lint, which unavoidably occur when processing yarns, deteriorate the quality of the light transmission with increasing duration of operation. The sensor device then fails and the storing surface becomes empty, and this might lead to a defect in the product produced in the textile machine which is being supplied with yarn by the yarn feeding device. Therefore, it is customary operator cleans the light transmission path within periods based upon experience, e.g. by pressurized air or by sweeping. However, the cleaning steps are then carried out more often than necessary, or a disturbance occurs due to a lack of care of the operator.

It is the object of the present invention to provide a method of the kind as disclosed above, as well as a yarn feeding device which enable reliable detection of deteriorated scanning conditions which just barely allow correct operation of the sensor device in a structurally simple way and with a simple circuitry technique. The invention also enables elimination of these less than optimal scanning conditions so as to avoid defects in the product produced by the textile machine supplied with yarn by the yarn feeding device.

In the method according to the invention, an object-output signal generated for control purposes is also used to check the quality of the scanning conditions, e.g. the quality of the light transmission, by means of surface areas of the storing surface and/or a yarn which serve as the object. This does not require any appreciable additional components in the sensor device, or at the storing surface. The scanning conditions (or the light transmission quality) decisive for the function of the sensor device are examined in the scanning zone, i.e. at the exact location where they are decisive for the function of the sensor device for controlling the drive motor, and not at a location which is distant from the scanning zone. A deterioration of the scanning conditions will change the signal level of the output signal, and also the signal level of the test signal which is compared with a threshold value. The threshold value is set so as to correspond to a just barely acceptable deterioration of the scanning conditions. When the test signal finally falls below the threshold value the alarm signal is activated. By means of the alarm signal, an operator becomes alarmed just in time, i.e. neither too early nor too late, to clean the operating area of the sensor device, i.e. for example the light transmitting path. However, the alarm signal can also be used to automatically activate a cleaning device for the sensor device, which cleaning device automatically carries out a cleaning step, e.g. by blowing away or sweeping away contaminants.

In the yarn feeding device, an examination of the scanning conditions is made exactly at the location at which the object is scanned, i.e. at a location where the quality of the scanning condition is of decisive importance for correct functioning of the sensor device. Since the object-output signal itself is used as a basis for the test signal, no additional sensor components or auxiliary means are needed at the storing surface. Components already used for scanning the object are also used for the test routine, and as a result, the scanning condition is checked during operation periods only, and if scanning conditions deteriorate during an operation period, an alarm signal is generated which alerts the operating personnel to remove the disturbance is generated, during which operation periods a deterioration of the scanning condition might disturb the operation of the sensor device. Further, the examination is not carried out permanently, i.e. it is not carried out during unimportant time periods in which the scanning condition is of no influence on the operation of the sensor device. The structural features provided are advantageous with yarn feeding devices having a storing surface driven by the drive motor (rotatably driven storing body) as well as with yarn feeding devices having a stationary storing surface during operation (stationary storing drum and rotatably driven winding element), in order to reliably determine when a disturbance has to be eliminated.

The method according to the invention also includes monitoring the test signal and the object-output signal, and a simple logical evaluation of the occurrence or the non-occurrence of both signals is carried out in order to generate the alarm signal at a correct point in time and on the basis of a correctly determined scanning condition.

Further, the test signal, as well as a speed signal for control purposes of the drive motor, are generated from the object-output signal. An examination of the scanning conditions is only carried out in the event that the drive motor must be driven when there is danger of emptying the storing surface. Although the alarm signal is generated when the test signal fails to appear, the speed signal still appears for unobstructed use.

According to another aspect of the invention, the output signal and the test signal are both compared with separate threshold values. The higher threshold value represents a just barely acceptable deterioration of the scanning conditions. The output signal and the test signal not only occur synchronously with one another, but are also identical in their signal levels which is decisive for comparison with the respective threshold value. Since the threshold value for the test signal is higher, the test signal fails to appear as soon as the just barely acceptable deterioration has occurred. The output signal is still present and can be used in the predetermined way for control purposes. In the absence of the test signal, however, the alarm signal is generated. The lower threshold value can suitably be set to correspond to a worse deterioration of the scanning conditions (as compared to the threshold value for the test signal) at which a correct operation of the sensor device is no more assured. In the event that the operator has not reacted to the alarm signal, the yarn feeding device, and appropriately also the textile machine supplied with yarn by the yarn feeding device, can be switched off when the output or speed signal also fails to appear, in order to avoid emptying of the storing surface.

Alternatively, both signals can be compared with the same threshold value. Prior to this comparison, the signal level of the test signal is changed so that upon the comparison of its signal level with the alarm-threshold value, precise information is gained indicating the need of an alarm signal.

The method is particularly useful with opto-electronical and contactless scanning in a yarn feeding device comprising an opto-electronic sensor device predictable relation between the signal level and the quality of the light transmission.

However, the application of this method, and the structural features for carrying out the method are not limited to optoelectronical scanning, and it is possible to use an output signal generated for a predetermined control purpose also for a testing routine with other contactless scanning modes (sound, induction, etc) and even with contact yarn scanning. It is, however, important that the output signal used for the test routine originates from the scanning of the object in the scanning zone and shows an easily evaluatable signal level which changes with a deterioration of the scanning conditions, e.g. due to dirt or dust deposits. The principle of the invention is also useful for yarn feeding devices having a stationary storing surface for the yarn. In this situation, the output signal need not necessarily be in the form of a signal chain, even though this might be advantageous in some cases.

With the yarn feeding device according to the invention, the object-output signal is used for the testing routine. The object-output signal represents the rotational speed of the drum and occurs exclusively when the drum is driven due to absence of yarn in the scanning zone. By means of the test signal which is formed from the object-output signal, the alarm signal can be generated simply and reliably, and exactly at a point in time when the scanning conditions have deteriorated accordingly. One particularly useful feature of the invention is that the operation of the sensor device is only checked when the drive motor is driven for replenishing the yarn store. In such a case, there is the risk of emptying the storing surface, because the boundary of the yarn store trails behind the scanning zone due to consumption. If the drive motor is not driven, no test routine is carried out. This is then uncritical, because there is a sufficiently big yarn store already on the storing surface, which yarn store extends into the scanning zone. Elimination of the disturbance or cleaning is carried out expediently when the drive motor is at a standstill, so that the yarn feeding device does not have to be switched off, and the production process of the textile machine, which is supplied with yarn by the yarn feeding device, does not have to be interrupted.

According to one embodiment of the yarn feeding device, despite the absence of the test signal, the still occurring output signal is used as a speed signal for control purposes, and the alarm signal is generated separately. It is useful to use the microprocessor of the control device of the yarn feeding device (which microprocessor is typically provided in any event) as a combining or monitoring means for the above purpose, because the microprocessor usually has sufficient capacity for this additional program routine and thus only requires a software adaptation.

Further, in accordance with another embodiment, the microprocessor switches off the yarn feeding device, and, expediently, also the textile machine supplied with yarn from the yarn feeding device, via a switch or switch-off member, namely as soon as the speed signal compared with the threshold value also fails to appear. The invention thus incorporates a dual-safety feature in the event that the operator fails to respond to the alarm signal and eliminate the disturbance.

In another embodiment, a voltage divider produces the same signal level for the output signal and the test signal, and two comparators compare the two signal levels with two different threshold values. As a consequence, the speed signal which may possibly be needed for control purposes still occurs, even when the scanning conditions have deteriorated to a just barely acceptable degree, although the test signal has failed to appear and the alarm signal is generated.

In contrast, in an alternative embodiment, the signal level for the test signal is changed in relation to the signal level of the output signal already in the voltage divider. The speed signal which may possibly be needed for control purposes can still be derived from the output signal, while with a just barely acceptable deterioration of the scanning conditions, the test signal fails to appear and the alarm signal is generated.

In another embodiment, a very reliable, preferably opto-electronical, yarn scanning with a precise control of the drive motor is achieved by providing the plurality of single sensors, with only the output signal of one of the single sensors being used for the test routine.

BRIEF DESCRIPTION OF THE DRAWINGS

Embodiments of the invention will now be described with reference to the drawings, in which.

DETAILED DESCRIPTION

Figure 1:
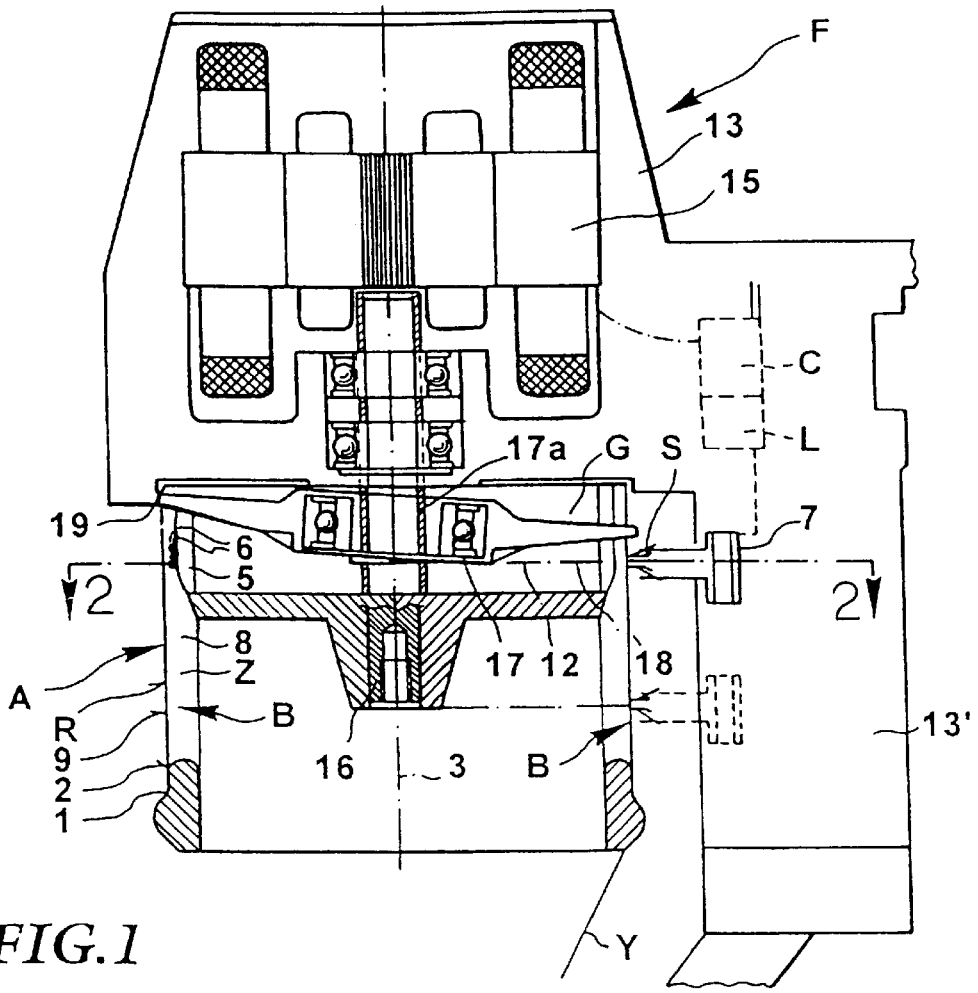
FIG. 1 is a longitudinal cross-sectional view of a yarn feeding device.
Figure 2:
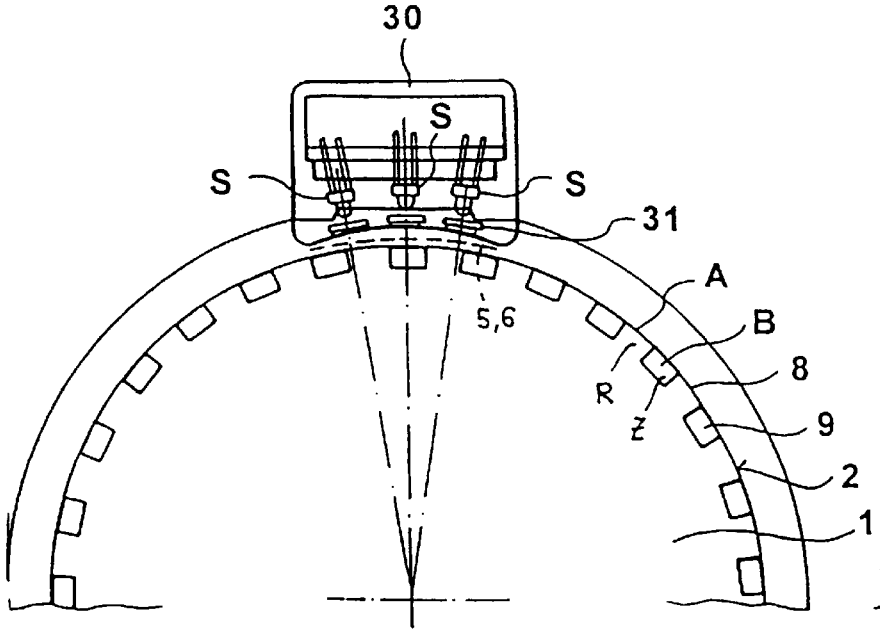
FIG. 2 is a horizontal cross-sectional view taken generally along line 2—2 in FIG. 1.

A yarn feeding device F according to FIG. 1, particularly a yarn feeding device for a knitting machine, includes a housing 13 for an electric drive motor 15 for rotatably driving a drum 1 via a shaft 16. Within a holding bracket 13' secured to housing 13, an opto-electronic sensing device 7 is provided. The sensing device 7 contains (FIG. 2) a plurality of sensors S which are arranged in a spaced-apart manner in the circumferential direction and are oriented towards a scanning zone (12) (shown in dash-dotted fashion). The sensor device 7 is, for instance, adjustable in a direction parallel to the drum axis. Sensor device 7 is connected via a control circuit L to a control device C of drive motor 15. Each of the sensors S may consist of a light source of its own, e.g. infra-red light, and a receiver, e.g. a photodiode which responds to reflected light.

Drum 1 defines a storing surface 2 for a yarn store 5 consisting of windings 6 of yarn Y which is withdrawn overhead of drum 1 and consumed upon demand by the textile machine (not shown), e.g. a knitting machine. Yarn Y is supplied to drum 1 in an upper region of drum 1 in FIG. 1 and is wound up by the rotation of drum 1, the drive motor 15 being controlled such that despite a varying consumption of the yarn 5, the motor 15 serves to maintain the yarn store 5 such that the yarn store 5 extends to the scanning zone 12. If yarn is present in the scanning zone 12, the drive motor 15 is stopped or decelerated. If there is no yarn present in the scanning zone 12, the drive motor 15 is driven or accelerated. Via control device C, the drive speed of the drive motor 15 is approximately adapted to correspond to the yarn consumption.

Drum 1 can be designed as a bar cage with longitudinally extending bars R separated by interspaces Z. Instead of clear interspaces Z, longitudinal grooves could also be provided in drum 1, said grooves opening outwardly. Furthermore, it is possible to use a drum 1 with a smooth surface having surface areas A, B which alternate with one another in the circumferential direction and which have clearly different, e.g. optical, scanning properties. In the illustrated embodiment, bars R and interspaces Z define first and second circumferential sections 8, 9 with clearly different scanning properties for the sensors 5 of sensor device 7. The surface areas A, B ought to be distributed regularly in circumferential direction. The sensor device 7 of the shown embodiment contains three sensors S which are spaced from each other in the circumferential direction such that at least one sensor S scans a first circumferential section 8 while at least a second sensor S simultaneously scans a second circumferential section 9.

In drum 1 a spoke star 19 is provided as an advance element G, with the spokes 18 of the spoke star 19 extending through the interspaces Z to a rotational bearing 17 on shaft 16. The rotational bearing 17 and the spoke star 19 are inclined in relation to the axis 3 of drum 1. Since the rotational bearing 17 is mounted on a collar 17*a* which is prevented from rotating with shaft 16, the spoke star 19 moves the yarn store 5 axially forward in a direction towards the scanning zone 12. Alternatively, a similar advance effect could be achieved by a conical design of the drum 1 at the yarn feed side.

The sensors S are jointly provided in a housing 30. Light-transparent covering screens 31, or a covering window shared by all sensors S, protect the sensors S against direct contamination. Contaminants may be deposited on or in front of the covering screens 31 or the covering window, and/or in the scanning zone 12 of drum 1.

Figures 3, 4:
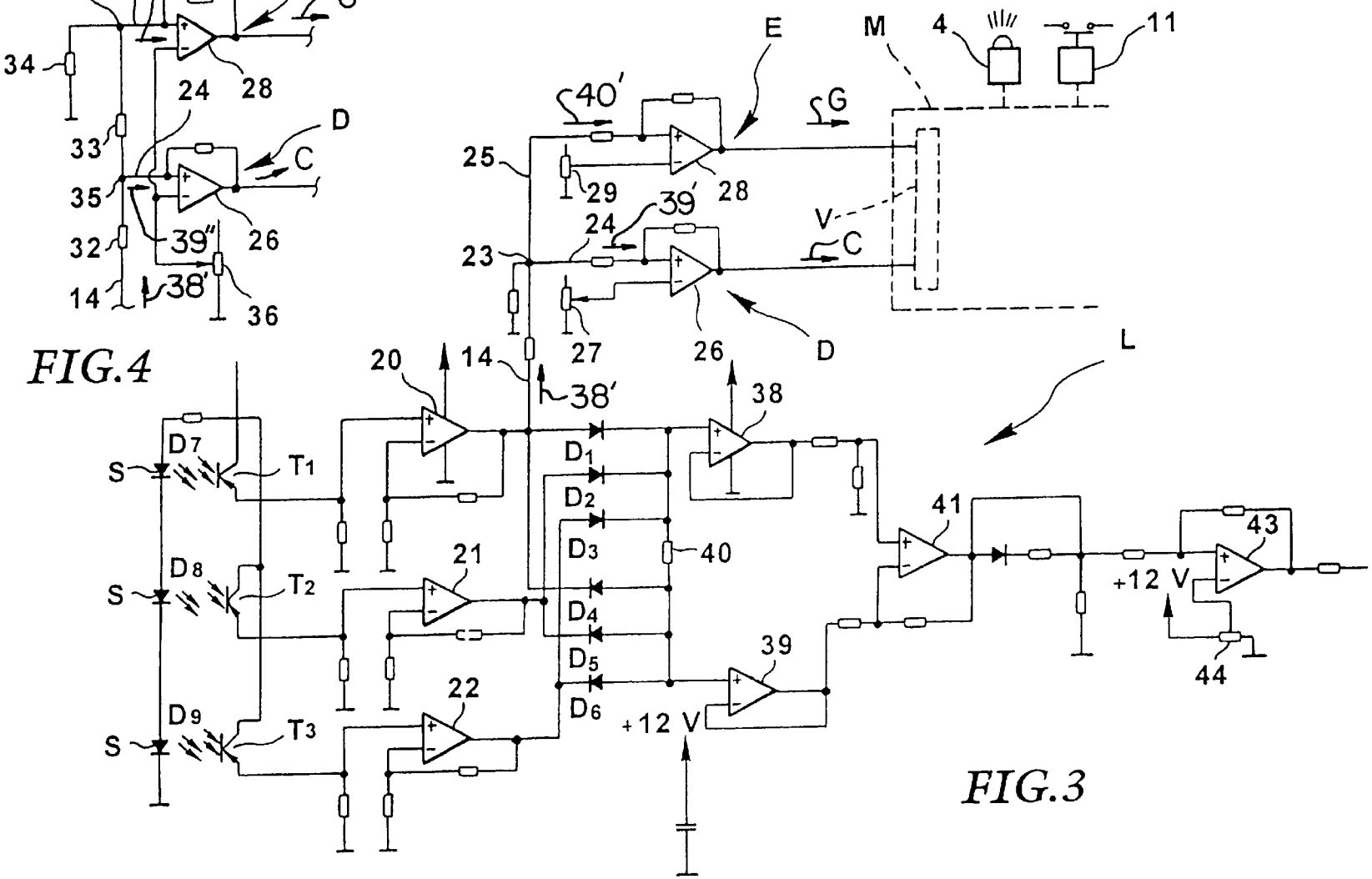
FIG. 3 is a schematic or block diagram of a control circuit.
FIG. 4 is a detail view of a variant of the FIG. 3 control circuit.

FIG. 3 schematically illustrates in a block diagram a possible embodiment of a control circuit L for generating drive control signals for drive motor 15 on the basis of the output signal of sensor device 7, or on the basis of the output signals of the sensors S.

The sensors S consist of transmitters D7, D8 and D9 and receiver elements T1, T2 and T3, preferably operating with infra-red light. The sensors, the receivers and operational amplifiers 20, 21 and 22 cooperating therewith, are jointly connected to a source of constant voltage. The infra-red radiation received by receiver elements T1, T2 and T3 generates a photo-current which influences the voltage at the working resistors. These voltages are amplified in the operational amplifiers 20, 21 and 22. The outputs of the operational amplifiers 20, 21 and 22 are connected via a diode network $D_1$-$D_6$ to a centrally provided working resistor 40. The diodes are polarized and interconnected so that the positive active voltages are brought to the upper point of the working resistor 40 and the negative active voltages are brought to the base point of the working resistor. Thus, a maximum differential voltage is generated at working resistor 40 between the maximum highest positive voltage and the maximum lowest negative voltage. The positive value is transmitted via an amplifier 38 to a differential amplifier 41, while the negative value is brought to the same differential amplifier 41 via an amplifier 39. The voltage at the output of the differential amplifier 41 corresponds to the proportional part of the yarn store on the storing surface. The voltage at the output of the differential amplifier 41 is supplied via a diode and a resistor network to a comparator 43. The desired value of the yarn store size can be adjusted at a potentiometer 44. Comparator 43 supplies the control device of drive motor 15 with the commands: Run or Stop.

The output signal of a sensor element S(D1, T1) is additionally taken across 14 at the operational amplifier 20 and is supplied to a circuit part D as well as to a parallel circuit part E.

A line 24 connects point 23 to one input of a comparator 26, the other input of which comparator 26 is connected to an adjustable threshold value member 27. The output of comparator 26 is connected to a combining or monitoring device V, which, preferably, is integrated into a microprocessor M. Microprocessor M has connected thereto an alarm-signal emitter 4 and, optionally, a switch-off member 11. The parallel circuit part E branches off at point 23 with a line 25 being connected to one input of a second comparator 28, the other input of which is connected to a second threshold value member 29. The output of the second comparator 28 is also connected to device V. Threshold value member 27 is set to a low threshold value, which corresponds to a signal level below which the sensor device 7 would no longer be able to function, e.g. due to deteriorated light transmission quality. By contrast, threshold value member 29 is set to a higher threshold value representing a just barely acceptable deterioration of the light transmission quality, at which deterioration the sensor device is still able to operate correctly, but removal of the contaminants influencing the light transmission quality is already advisable.

In circuit part D, a rotational speed signal which represents the speed of drum 1 is generated on the basis of the output signal. The speed signal is provided via the device V in the microprocessor M and is adapted to be used for evaluation. The microprocessor compares in an equivalency logic the presence of both signals from comparators 28 and 26. In case both signals become unequal or one of the signals fails to appear, an alarm must be initiated.

A test signal is formed synchronously and essentially at the same time and with the same signal level as the output signal. Since threshold value member 29 is set to a higher threshold value than threshold value member 27, the test signal fails to appear at the device V as soon as its signal level falls below the threshold value. The signal emitter 4 is activated by means of microprocessor M in order to, preferably, emit an optical or acoustical signal. If the contaminants are not removed, the microprocessor M may then activate the switch-off member 11 as soon as the speed signal also fails to appear, and may switch off the yarn feeding device and the textile machine in order to avoid any emptying of the drum 1.

FIG. 4 illustrates a variant of the circuit part D and the parallel circuit part E. A voltage divider, consisting of resistors 32, 33, 34, is provided in line 14. At point 35 between resistors 32 and 33, line 24 branches off to one input of comparator 26. At point 37 between the resistors 33 and 34, line 25 branches off to one input of the second comparator 28. The signal level (voltage level) of the output signal is lower at point 37 (test signal) than at point 35. Each second input of the first and second comparators 26, 28 is connected to a common threshold value member 36 set to a predetermined threshold value (a reference voltage). This threshold value 36 is precisely adjusted to the point at which the contamination reaches a limit at which the contamination is just barely acceptable, but too high for the signal level of the test signal. By means of the voltage divider 32, 33, 34, comparator 28 switches at a higher threshold than comparator 26. In case the sensor device 7 is contaminated, accordingly, the comparator 28 is no longer able to switch. By means of the equivalency examination of the output voltages of the comparators 26, 28 the microprocessor M determines that an alarm signal has to be emitted, and the alarm signal emitter 4 is activated.

Figure 5:
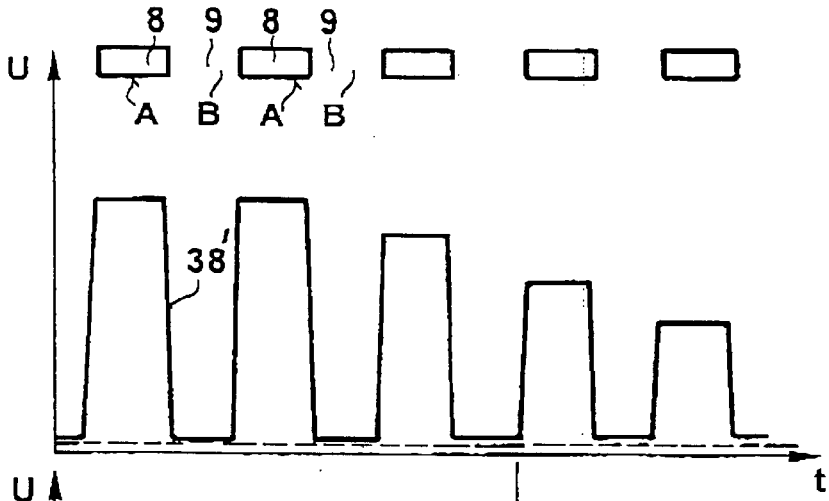
FIGS. 5, 5A, 5B, and 5C are schematic U/t signal diagrams.
Figure 5A:
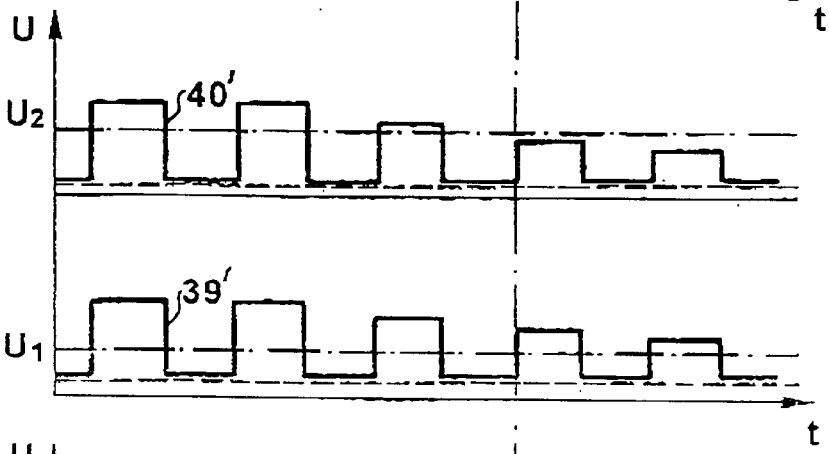

For a better understanding of the above-mentioned testing routine; reference is made to FIGS. 5, 5A, 5B and 5C. FIG. 5 illustrates in a U vs. t diagram the object-output signal 38' in line 14, and how same is generated by the sensors S, D7, T1 depending upon the passing of the circumferential sections 8, 9 or the surface areas A, B, which are different from each other. At the two first signal levels the light transmission quality is still excellent. Starting with the third signal level in FIG. 5, the quality of the light transmission decreases. Within control circuit L according to FIG. 3, a signal 39' is present, as shown in the diagram of FIG. 5A. The threshold value set at the threshold value member 27 is indicated by U1. At the output of comparator 26 a signal train C occurs according to FIG. 5C. By contrast, at the output of comparator 28 a signal train G occurs according to FIG. 5C. After point X in time, signal train G is no longer present. An examination of equality of the signal trains leads to a logical signal train H in FIG. 5C. At point X in time microprocessor M activates the alarm signal member 4.

Figure 5B:
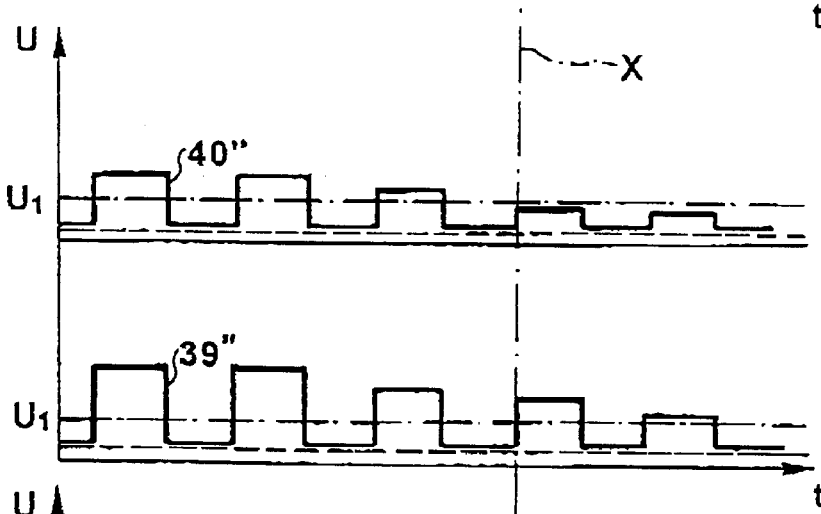
Figure 5C:
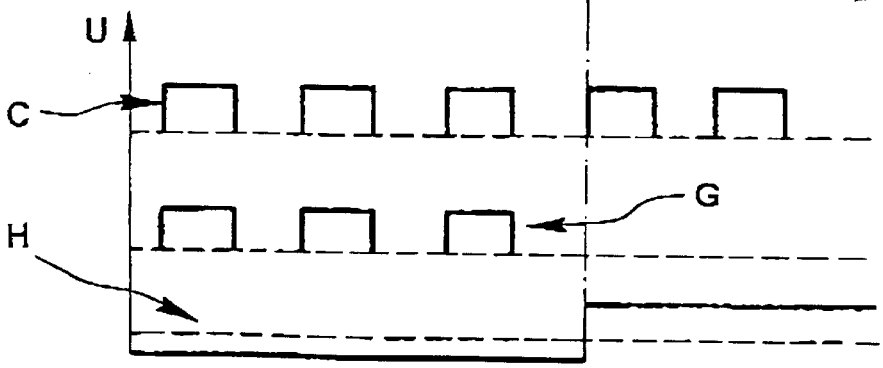

Threshold value U2 in FIG. 5A represents a just barely acceptable deterioration of the scanning conditions, i.e. the light transmission quality, at which the sensor device 7 is able to still correctly operate, as it is shown in the lower part of FIG. 5A, by means of the still existing signal 39' after point X in time and by signal train C in FIG. 5C. It should be noted that the light transmission quality normally decreases during an essentially longer period of time than can be derived from FIGS. 5, 5A, 5B, 5C. These figures are schematic with respect to the time duration and only serve to aid in understanding.

The diagram according to FIG. 5B corresponds to the variant according to FIG. 4. In the lower part of FIG. 5B, output signal 39" is identical to the output signal 39' of FIG. 5A. The threshold value U1 equals the threshold value U1 of FIG. 5A. In the upper part of FIG. 5B it can be seen that by influence of the voltage divider the signal levels of a test signal 40" derived from the object-output signal 38' are each lower than the signal level of the signal 39"; for test signal 40", however, the same threshold value U1 is considered as for signal 39". The first three signal levels of the test signal 40" are sufficiently high to pass the second comparator 28. The fourth signal level is, however, lower than the threshold value U1, so that then test signal 40" fails to appear at the combining device V and the alarm signal is generated.

By means of the circuit part D and the parallel circuit part E and the components arranged therein, an checking device is created for evaluating the correspondence between the test signal and the speed signal. This checking device can be realized very simply in the microprocessor M by software adaptation. The examination of the quality of the light transmission is only carried out when the drive motor is driven for replenishing the yarn store, since with a stopped drum the sensor device only scans the yarn and does not see the reflecting bars R and cannot reliably judge the quality of the reflecting light transmission.

The method can also be used for other physical scanning principles, e.g. when scanning by means of sound, induction, magnetism, capacitance, or the like.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A method of monitoring the scanning conditions during control of a yarn feeding device for feeding yarn to a textile machine, the yarn feeding device including a surface for storing yarn in windings, a drive motor for winding yarn onto the storing surface to replenish same with yarn, a sensor device including at least one sensor oriented towards a scanning zone defined by the yarn feeding device, and a control circuit connected to the sensor device, said method including:

(1) generating an object-output signal with the sensor to control the drive motor in response to a movement or the presence or absence of an object in the scanning zone, the signal level of the object-output signal being dependent upon the quality of the scanning conditions;

(2) generating a test signal based upon the object-output signal substantially synchronously with said step (1);

(3) comparing the signal level of the test signal with a threshold value corresponding to a just barely acceptable deterioration level of the scanning conditions; and (4) generating an alarm signal when the signal level of the test signal falls below the threshold value.

2. The method according to claim 1 including monitoring the test signal and the object-output signal, and when the test signal is no longer present and the object-output signal is present, generating the alarm signal.

3. The method according to claim 1 including detecting, with the sensor device, the absence of yarn in the scanning zone and thereupon rotating the storing surface with the drive motor to wind yarn thereon, and generating a signal corresponding to a rotational speed of the storing surface, the test signal and the speed signal both being generated from the object-output signal of the sensor device.

4. The method according to claim 3 wherein the threshold value is a first threshold value, said method including providing the speed signal and the test signal with essentially equal signal levels, comparing the signal level of the test signal with the first threshold value and comparing the signal level of the speed signal with a second threshold value lower than the first threshold value and corresponding to a worse deterioration level of the scanning conditions as compared to the first threshold value, and generating the alarm signal when the test signal is no longer present, and generating a signal for switching off at least one of the yarn feeding device and the textile machine when both the test signal and the speed signal are no longer present.

5. The method according to claim 3 including providing the test signal with a signal level which is lower than the signal level of the speed signal, and comparing both the test signal level and the speed signal level with the threshold value.

6. The method according to claim 3 including generating the alarm signal when the test signal is no longer present and the speed signal is present.

7. The method according to claim 1 including providing an optoelectronic sensor device for optoelectronically scanning objects in the scanning zone.

8. A yarn feeding device for feeding yarn to a textile machine comprising:

a housing;

a surface for storing yarn;

a controllable drive motor disposed for driving a winding element which winds yarn onto the storing surface to define a yarn store of several windings;

a stationary signal-generating sensor device mounted on the housing and oriented towards at least one scanning zone defined on the storing surface for sensing the motion or the presence or absence of an object in the scanning zone; and a control circuit which processes an object-output signal generated by the sensor device and controls the drive motor based upon the object-output signal, the signal level of the object-output signal being dependent upon the quality of the scanning conditions at the sensor device;

said control circuit including a parallel circuit part for generating and evaluating a test signal which is generated substantially synchronously with and is formed from the object-output signal, said control circuit being connected to an alarm-signal emitter which is actuable upon a change in the signal level of the test signal which corresponds to a just barely acceptable deterioration level of the scanning conditions at the sensor device.

9. The yarn feeding device according to claim 8, wherein the winding element is a drum which defines the storing surface thereon and is rotatably drivable by the drive motor, said drum having surface areas adjacent the scanning zone which alternate with one another circumferentially along the drum and have scanning properties which are different from one another, wherein when yarn is absent from the scanning zone and the drum rotates relative to the sensor device, the surface areas are scanned by the sensor device as the object, said sensor device generating the object-output signal during the scanning of the surface areas when the drum is rotating, said object-output signal corresponding to a rotational speed of the drum, the parallel circuit part including a threshold value member which sets a threshold value corresponding to a just barely acceptable deterioration level of the scanning conditions at the sensor device and at least one of the surface areas being scanned, said parallel circuit part being adapted to compare the test signal with the threshold value set by the threshold value member.

10. The yarn feeding device according to claim 8 wherein the sensor device comprises an optoelectronic sensor device for generating the object-output signal having a signal level dependent upon the light transmission quality of the sensor device.

11. The yarn feeding device according to claim 8 wherein the winding element is a drum which defines the storing surface and is rotatably driven by the drive motor, the control circuit includes a circuit part for deriving a signal from the object-output signal which corresponds to a rotational speed of the drum, the circuit part and the parallel circuit part being jointly connected to a microprocessor, and the microprocessor including a program routine which actuates an alarm signal when the speed signal is present and the test signal is absent.

12. The yarn feeding device according to claim 11 wherein the microprocessor is connected to a switch which is actuated by the program routine to switch off the yarn feeding device when, in the activated state of the drive motor, the speed signal is absent.

13. The yarn feeding device according to claim 11 wherein the circuit part and the parallel circuit part are jointly connected to a voltage divider, the circuit part is connected to a first input of a first comparator, an output of said first comparator being connected to the microprocessor, and a second input of said first comparator is connected to a first threshold value member which sets a first threshold value comprising a first reference voltage, and the parallel circuit part is connected to a first input of a second comparator, an output of said second comparator being connected to the microprocessor, and a second input of said second comparator is connected to a second threshold value member which sets a second threshold value comprising a second reference voltage which is higher than said first reference voltage.

14. The yarn feeding device according to claim 13 wherein said control circuit is adapted to provide said test signal and said speed signal with essentially equal signal levels.

15. The yarn feeding device according to claim 11 wherein said control circuit comprises a voltage divider including a resistor, the circuit part is connected to said voltage divider upstream of said resistor and the parallel circuit part is connected to said voltage divider downstream of said resistor, said circuit part is connected to an input of a first comparator and an output of said first comparator is connected to the microprocessor, the parallel circuit part is connected to an input of a second comparator and an output of said second comparator is connected to the microprocessor, and a second input of each of the first and second comparators is connected to a common threshold value member which sets a single threshold value comprising a single reference voltage.

16. The yarn feeding device according to claim 4 wherein the sensor device is provided with a plurality of optoelectronic sensors which are circumferentially spaced from one another in relation to the drum, each said sensor including a transmitter and a receiver element associated with said transmitter, and both the circuit part and the parallel circuit part are connected to only one of said optoelectronic sensors.

* * * * *

UNITED STATES PATENT AND TRADEMARK OFFICE

CERTIFICATE OF CORRECTION

PATENT NO. : 6,125,663
DATED : October 3, 2000
INVENTOR(S) : Friedrich Weber

It is certified that error appears in the above-identified patent and that said Letters Patent is hereby corrected as shown below:

Column 12,
Line 3, change "claim 4" to -- claim 8 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*